US005315352A

United States Patent [19]

Nakane et al.

[11] Patent Number: 5,315,352

[45] Date of Patent: May 24, 1994

[54] IMAGE FORMING APPARATUS FOR FORMING AN IMAGE ON AN IMAGE BEARING MEMBER

[75] Inventors: Rintaro Nakane; Jiro Egawa, both of Kanagawa, Japan

[73] Assignee: Kabushiki Kaisha Toshiba, Japan

[21] Appl. No.: 900,450

[22] Filed: Jun. 18, 1992

[51] Int. Cl.[5] ..... G03G 21/00

[52] U.S. Cl. ..... 355/246; 355/208

[58] Field of Search ..... 355/208, 245, 246, 326, 355/327

[56] References Cited

U.S. PATENT DOCUMENTS

| | | | |
|---|---|---|---|
| 4,708,459 | 11/1987 | Cowan et al. | 355/77 X |
| 4,780,744 | 10/1988 | Porter et al. | 355/208 |
| 4,908,666 | 3/1990 | Resch, III | 355/246 |
| 4,910,557 | 3/1990 | Imai | 355/246 |
| 5,081,491 | 1/1992 | Lux et al. | 355/208 |
| 5,150,155 | 9/1992 | Rushing | 355/208 |
| 5,175,585 | 12/1992 | Matsubayashi et al. | 355/208 |

*Primary Examiner*—Leo P. Picard
*Assistant Examiner*—Christopher Horgan
*Attorney, Agent, or Firm*—Banner, Birch, McKie & Beckett

[57] ABSTRACT

An image forming apparatus, in accordance with the present invention, forms a color image on an image bearing member. The image forming apparatus includes a charging device for electrically charging the image bearing member, an exposing device for exposing a light beam on the image bearing member so as to form a latent image on the charged image bearing member corresponding to image data to be formed, and a developing device for developing the latent image formed on the image bearing member with a developing agent including toner. The image forming apparatus also includes a detecting device for detecting the amount of toner attached to the image bearing member by the developing device, an estimating device for estimating the amount of toner attached to the image bearing member in accordance with image data to be formed, and a control device for controlling the charging device, the exposing device and the developing device in accordance with the detected toner attaching amount and the estimated toner attaching amount so as to stabilize image density changes of the image formed on the image bearing member. Thereby, the image forming apparatus of the present invention can correct for image density variations due to a change in the operating environment or a deterioration over time independently of the conventional maintenance of image forming materials and processes, and forms an image having a stable high image density.

16 Claims, 14 Drawing Sheets

IMAGE FORMING APPARATUS FOR FORMING AN IMAGE ON AN IMAGE BEARING MEMBER

BACKGROUND OF THE INVENTION

1. Field of the Invention

The present invention generally relates to an image forming apparatus, such as for use in forming an image on an image bearing member and, more particularly, for use in an image forming apparatus such as a color digital copying machine or a color laser printer, for forming a color image on the image bearing member.

2. Description of the Prior Art

Recently, the use of color in an image forming apparatus such as a copying machine or a laser printer has rapidly advanced. However, for example, in operating color copying machines, many users have experienced the problem that different images formed from the same original image using the same copying machines have different densities. In these conventional image forming apparatuses, the image density changes are influenced by a change or deterioration of the image forming conditions due to different operating environment factors and an elapse of time. Thus, it is important to stabilize the image density changes. In particular, in a color image forming apparatus, since the image density changes influence not only the density reproducibility but also color reproducibility, a stable image density is an indispensable requirement for maintaining color fidelity.

Therefore, in a conventional image forming apparatus, a given allowance margin (i.e., tolerance) is provided for the image forming materials and the image forming process itself, and image stabilization is attained to some extent by maintaining the materials and process variables within this allowable margin. However, the allowable margins that can be provided for the image forming materials and image forming processes are limited in conventional apparatuses. Also, the cycle in which the image density changes is shorter than a maintenance cycle so that an image having a stable image density may not form by only maintaining the material and process within tolerance. Maintenance cycle, as used herein, refers to the time period within which the tolerances or allowable margins for the image forming materials and process can be maintained.

SUMMARY OF THE INVENTION

Accordingly, it is an object of the present invention to provide an image forming apparatus which may correct image density changes due to a change in the operating environment or a deterioration over time independently of conventional maintenance of materials and process tolerances or allowable margins, and within a shorter cycle than the maintenance cycle.

It is another object of the present invention to provide an image forming apparatus which can form an image having a stable high image density on an image bearing member.

Accordingly, the foregoing objectives, as well as others, are achieved by the present invention, which provides an image forming apparatus that includes a forming device for forming an image on an image bearing member that corresponds to image data to be formed with a developing agent including toner under a predetermined image forming condition, a detecting device for detecting the amount of toner attached to the image bearing member by the forming device, an estimating device for estimating the amount of toner attached to the image bearing member in accordance with image data to be formed, and a control device for setting the image forming condition in accordance with the amount of toner detected by the detecting device and the amount of toner estimated by the estimating device, so as to stabilize the image density variations of the image formed on the image bearing member.

In accordance with another aspect of the present invention, the above-stated objects are achieved by providing an image forming apparatus for forming an image on an image bearing member whereby the image forming apparatus includes a charging device for electrically charging the image bearing member, an exposing device for exposing a light on the image bearing member so as to form a latent image on the charged image bearing member that corresponds to image data to be formed, and a developing device for developing the latent image formed on the image bearing member with a developing agent including toner. The image forming apparatus also includes a detecting device for detecting the amount of toner attached to the image bearing member by the developing device, an estimating device for estimating the amount of toner attached to the image bearing member in accordance with the image data to be formed, and a control device for controlling the charging device, the exposing device and the developing device in accordance with the amount of toner detected by the detecting device and the amount of toner estimated by the estimating device, so as to stabilize the image density variations of the image formed on the image bearing member.

BREIF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

Figure 2:
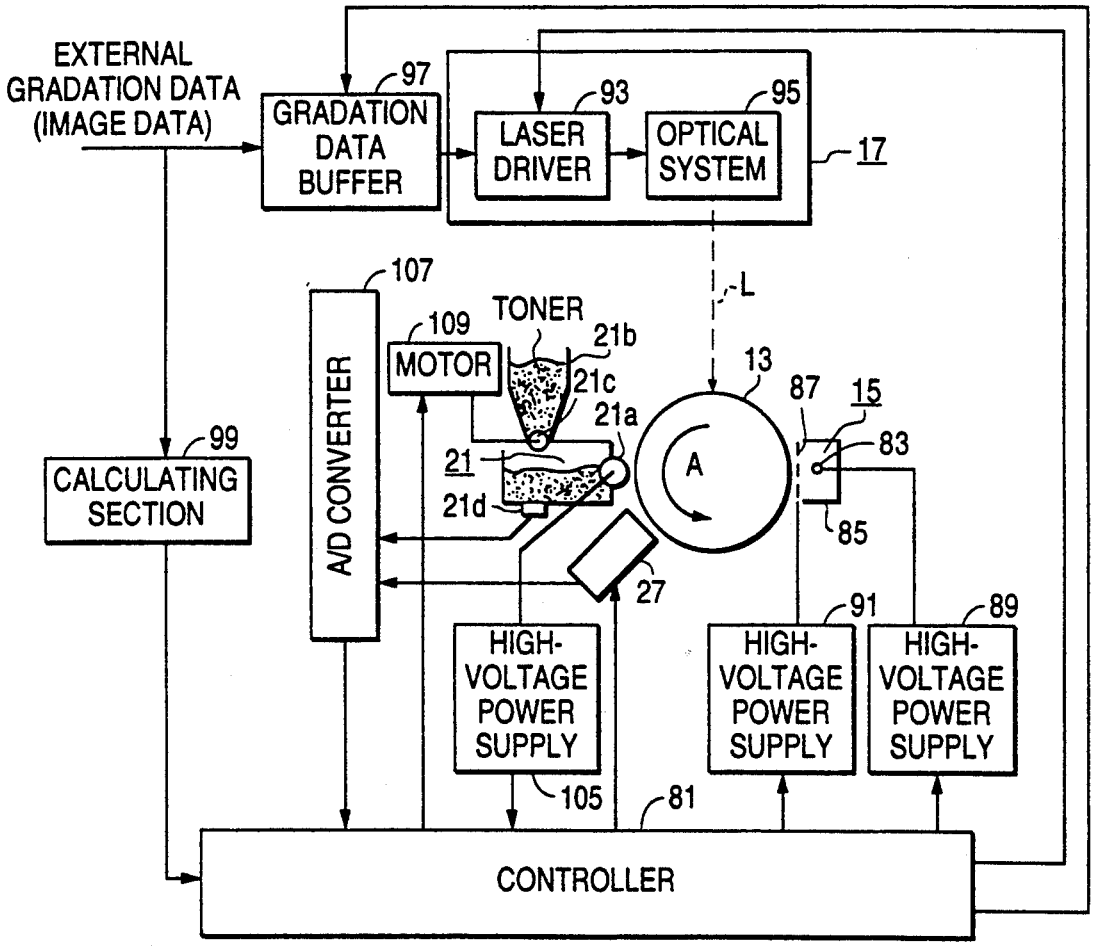
FIG. 2 is a block diagram showing a construction for controlling the image forming operation of the image forming apparatus shown in FIG. 1.
Figure 14A:
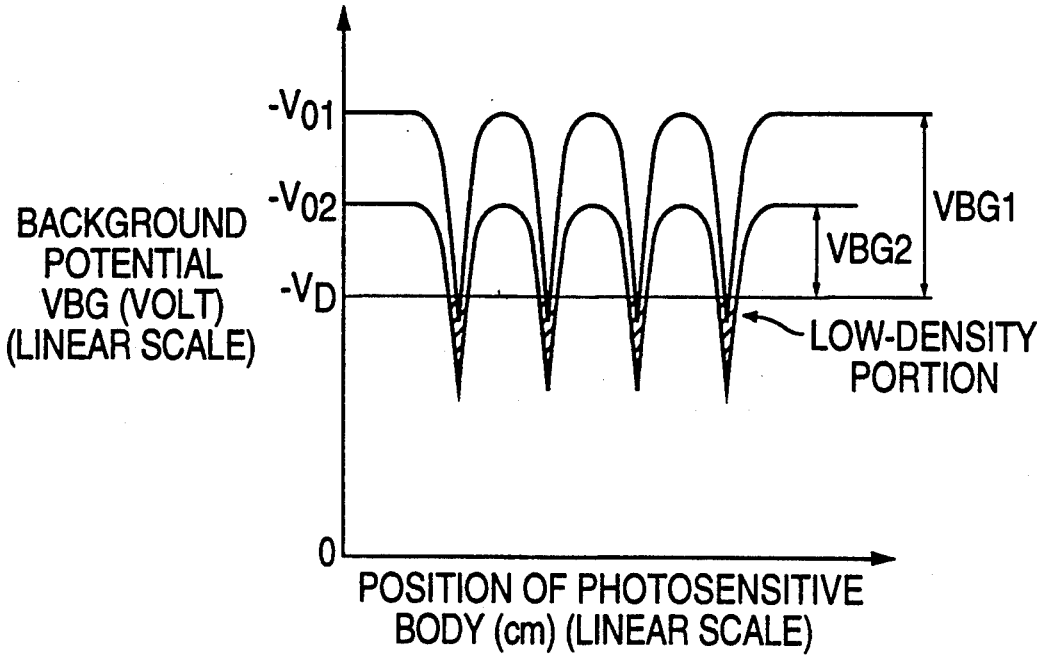
Figure 14B:
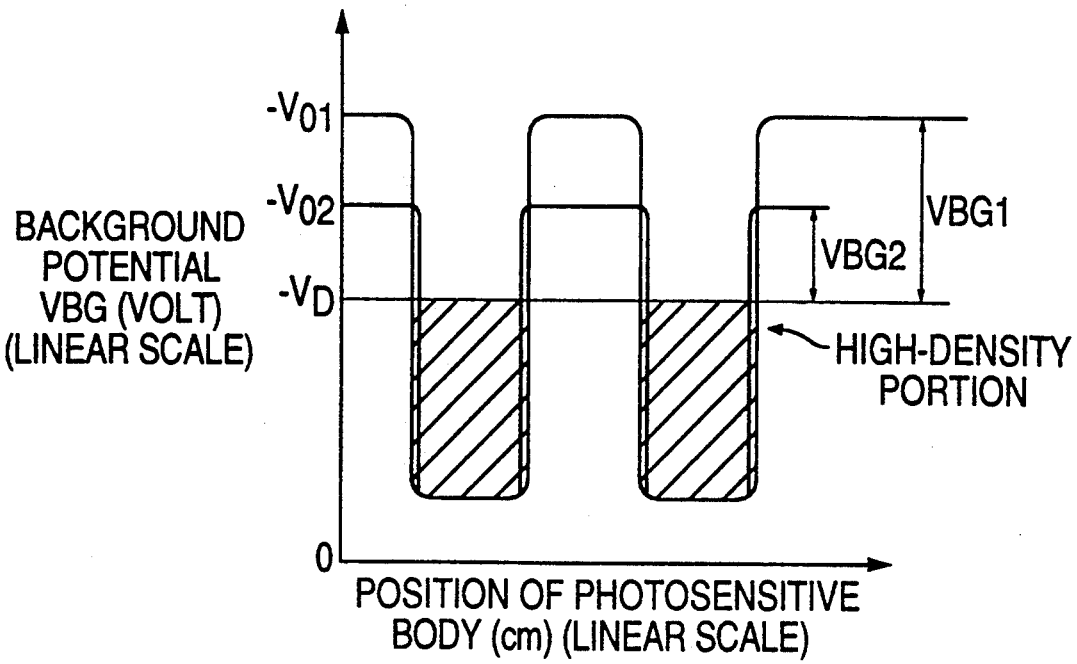
Figure 15:
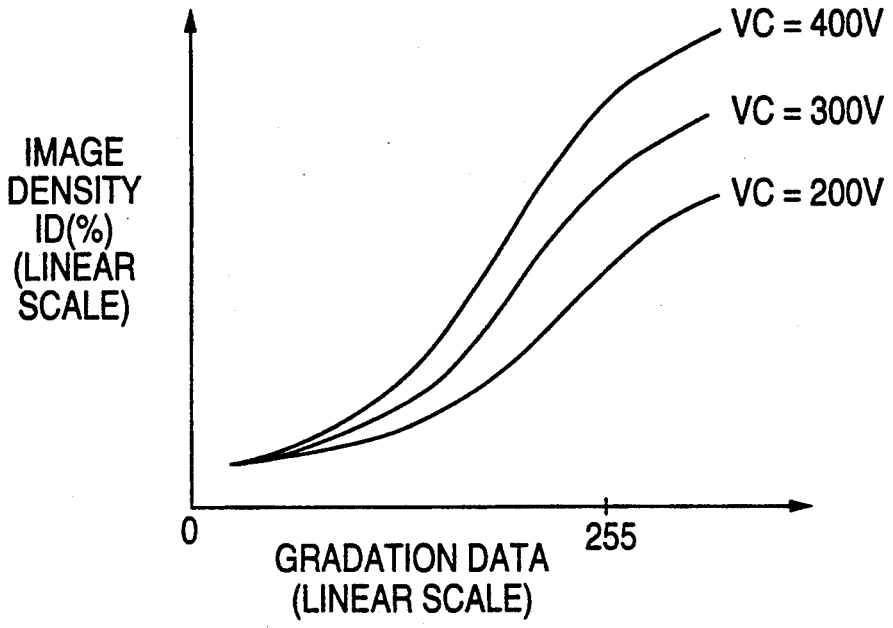
Figure 16:
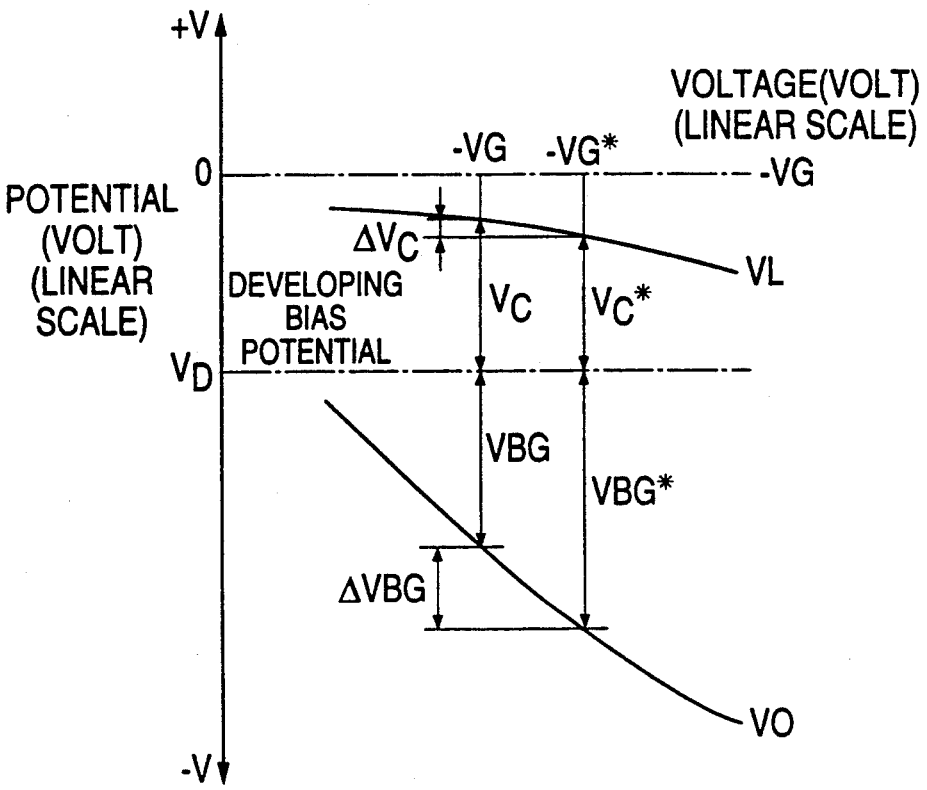
Figure 17:
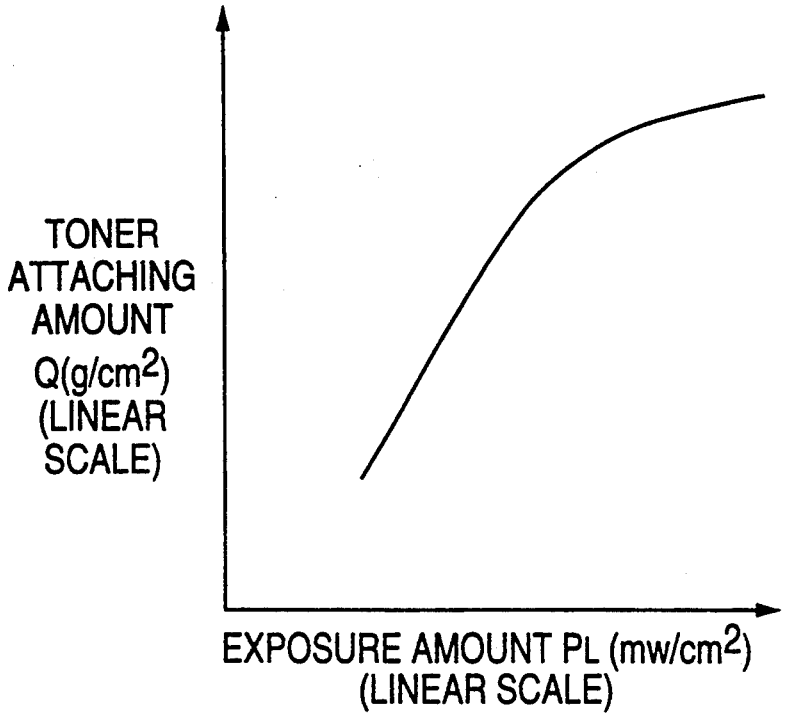
Figure 18:
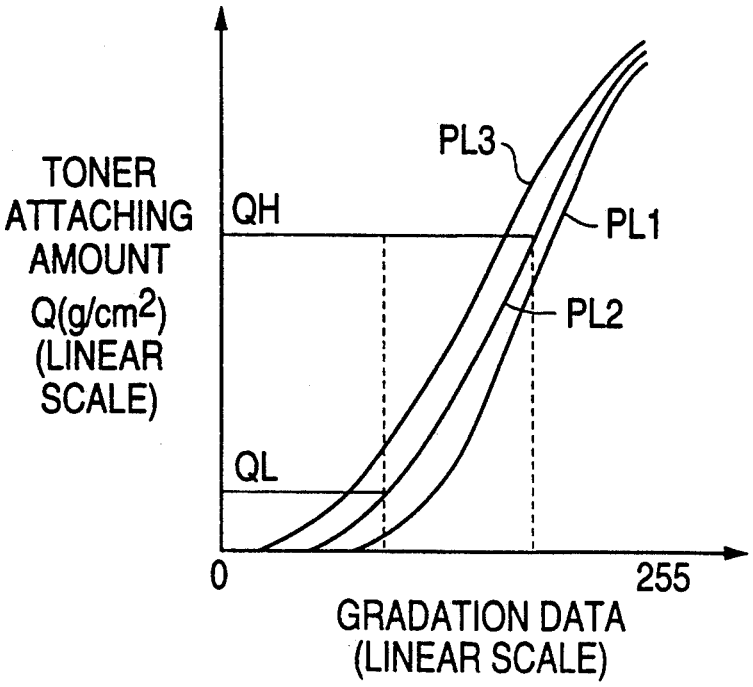
Figure 19:
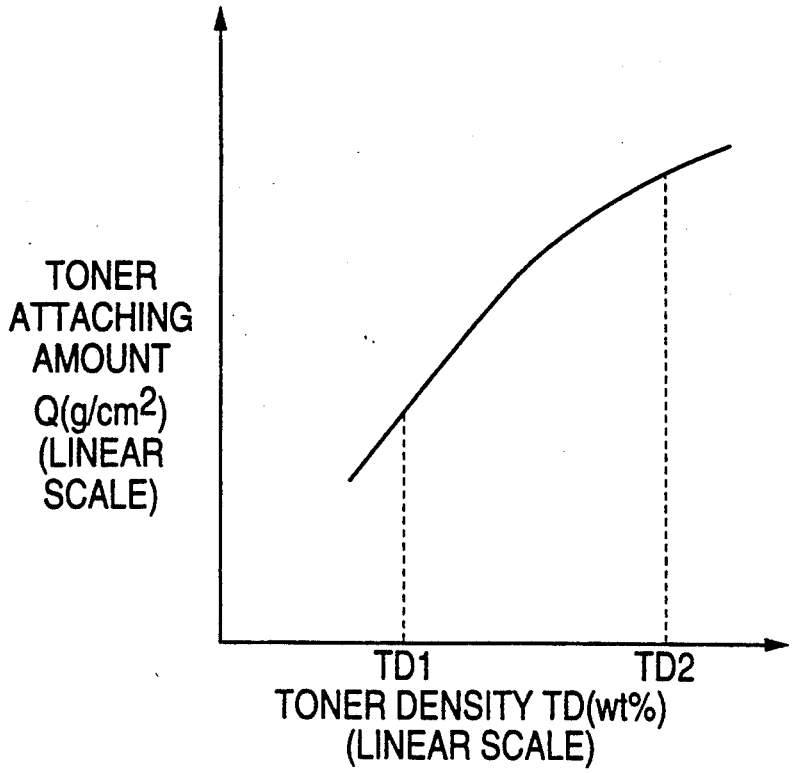
Figure 20:
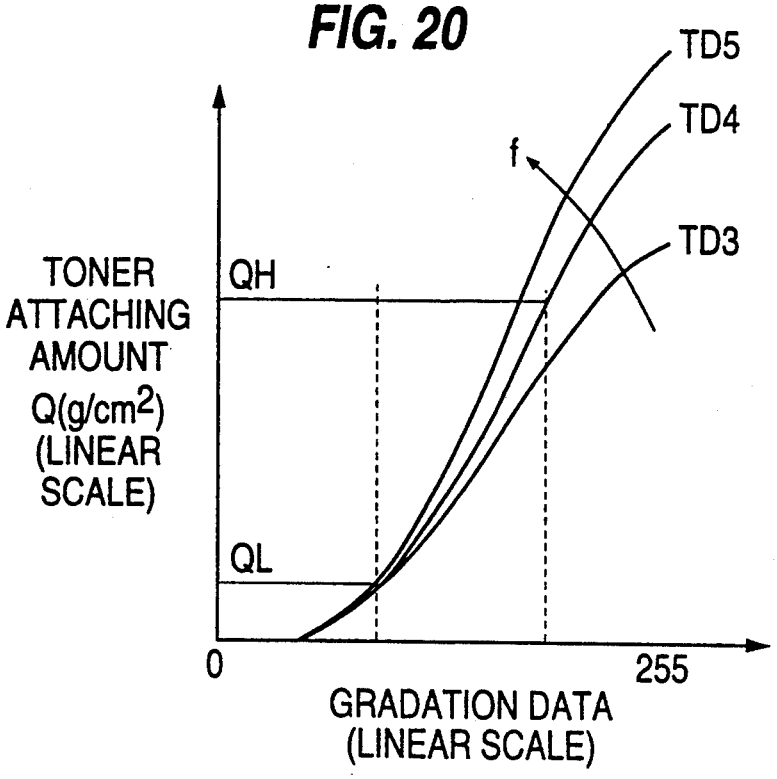
Figure 21:
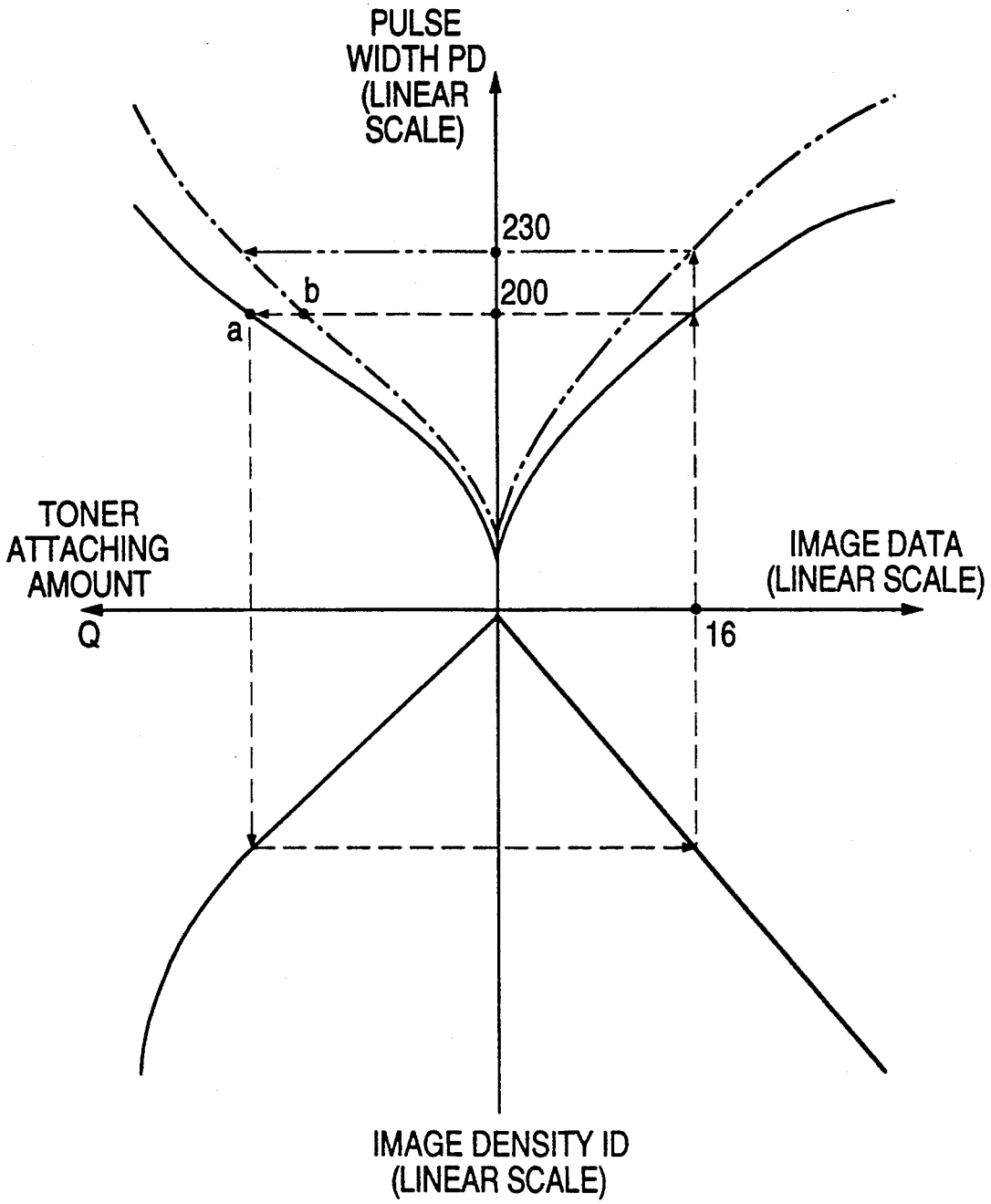
Figure 22:
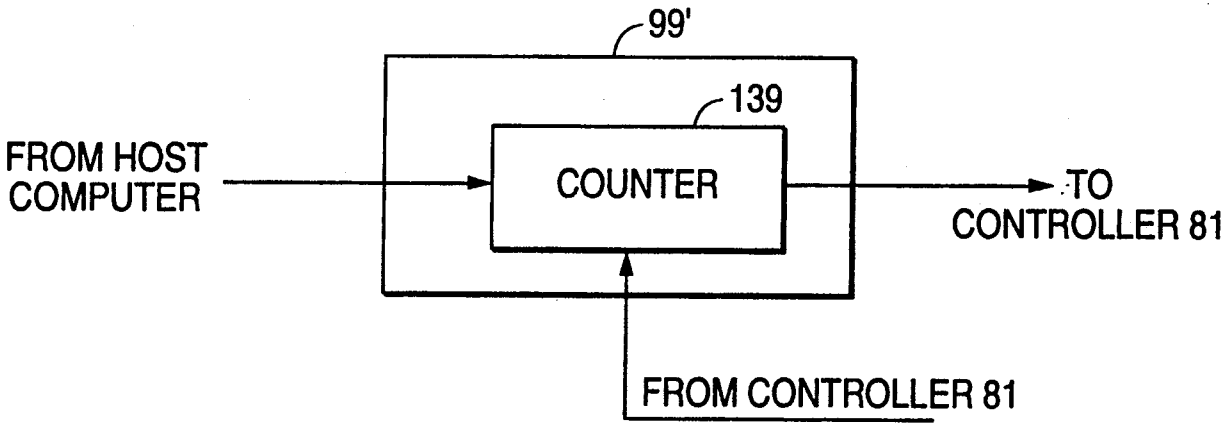

FIGS. 14(*a*) and (*b*) are graphs showing the relationships between the electrical potential of a non-exposed portion of the image bearing member, the potential of the density patterns, and a developing bias voltage applied to the developing unit shown in FIG. 2;

FIG. 15 is a graph showing the image density as a function of the contrast potential;

FIG. 16 is a graph showing the electrical potentials of the non-exposed portion and an exposed portion of the image bearing member and the developing bias voltage applied to the developing unit shown in FIG. 2 as a function of grid bias voltage applied to the main charger shown in FIG. 2;

FIG. 17 is a graph showing the amount of toner attached to the image bearing member as a function of the amount of exposure to a laser beam generated by the laser unit shown in FIG. 2;

FIG. 18 is a graph showing the amount of toner attached to the image bearing member as a function of the gradation data obtained when the amount of the exposure to the laser beam is changed;

FIG. 19 is a graph showing the relationship between the amount of toner attached to the image bearing member and toner density;

FIG. 20 is a graph showing changes in the amount of toner attached to the image bearing member as a function of the gradation data when the toner density is increased;

FIG. 21 is a graph showing the relationship between image data, the exposure amount of the laser beam, the amount of toner attached to the image bearing member, and the image density; and FIG. 22 is a block diagram showing another arrangement of the calculating section of the image forming apparatus shown in FIG. 2.

DETAILED DESCRIPTION OF THE PREFERRED EMBODIMENTS

Figure 1:
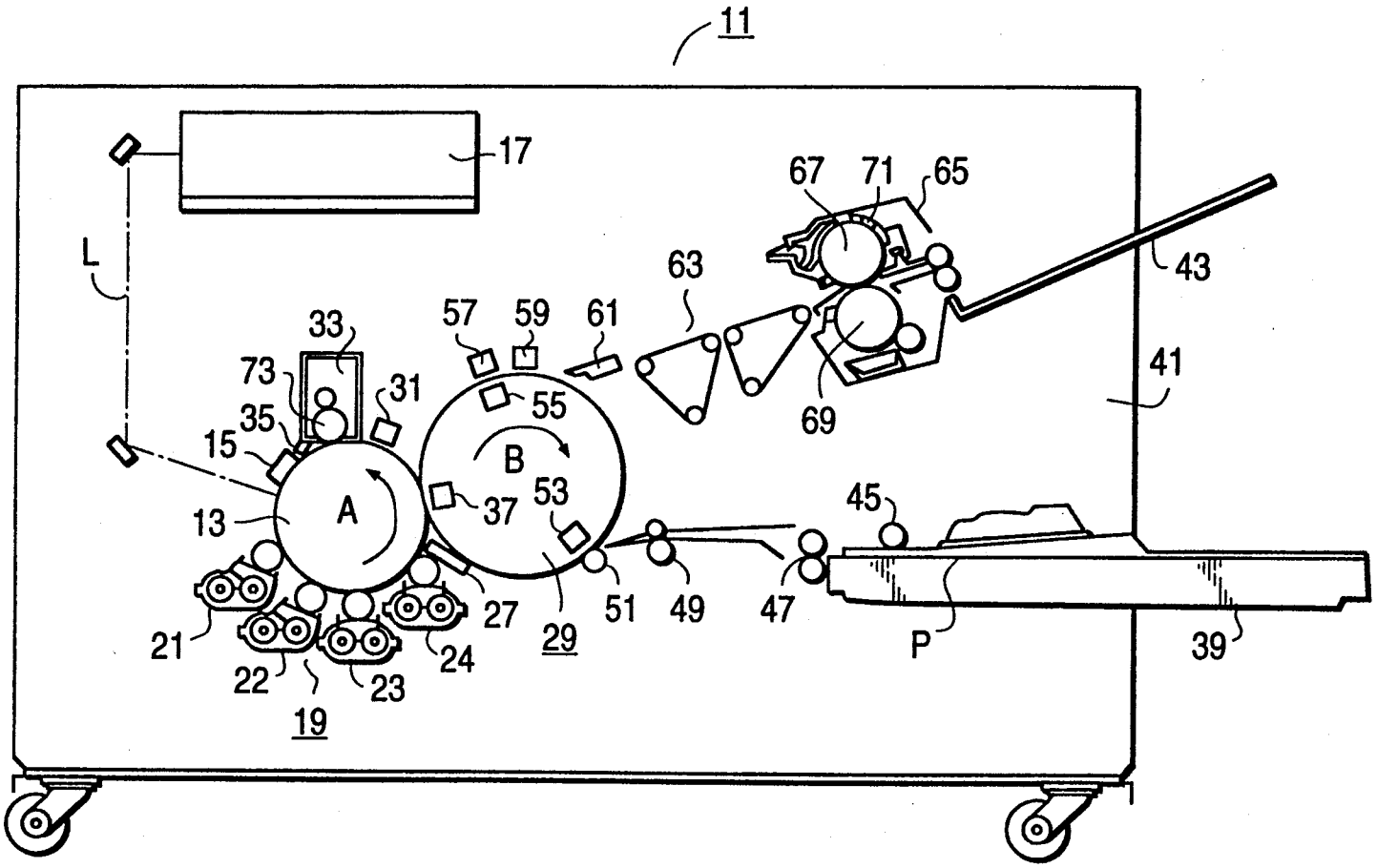
FIG. 1 is a schematic sectional view of an image forming apparatus in accordance with a preferred embodiment of the present invention.

In the following detailed description, like reference numerals will be used to denote like elements in FIGS. 1-22. Referring first to FIG. 1, an image forming apparatus, such as color laser printer 11, serves as an output device for a host computer (not shown). In response to a print command from the host computer, laser printer 11 forms an image on a recording medium, such as paper sheet P, according to the image data supplied from the host computer.

Laser printer 11 includes an image bearing member such as, for example, photosensitive drum 13, for forming a latent image in response to exposure to a light source. Photosensitive drum 13 is rotated by an electric motor (not shown) in the direction of arrow A.

Laser unit 17 radiates laser beam L in response to image data supplied from the host computer so that the latent image is formed on the surface of drum 13.

Main charger 15, developing unit 19, toner sensor 27, transfer drum 29, pre-cleaning discharger 31, cleaning unit 33, and discharging lamp 35, respectively, are arranged around the periphery of photosensitive drum 13 in the direction of its rotation.

Main charger 15 is located just prior to the laser beam radiation position on photosensitive drum 13 in the rotational direction indicated on drum 13. Main charger 15 charges the entire surface of photosensitive drum 13 to a uniform level of electrical charge in order to permit the formation of the latent image on the surface of drum 13 by laser unit 17.

Developing unit 19 is located further around the periphery of drum 13 in the indicated rotational direction of drum 13. Developing unit 19 includes first, second, third and fourth developing devices 21, 22, 23 and 24, which are respectively located further around the periphery of drum 13 in the indicated rotational direction of drum 13. For example, first developing device 21 may store magenta developing agent (toner), second developing device 22 may store cyan developing agent, third developing device 23 may store yellow developing agent, and fourth developing device 24 may store black developing agent. First, second, third and fourth developing devices 21, 22, 23 and 24 develop the latent image formed on photosensitive drum 13 corresponding to each respective color visible as a toner image. Thus, toner images corresponding to the respective colors are formed by these developing agents and devices.

Transfer drum 29 is located further around the periphery of drum 13 in the indicated rotational direction of drum 13. Transfer drum 29 is rotated by an electric motor (not shown) in the direction of arrow B. Transfer drum 29 includes transfer charger 37 which is located at the image transfer position. The toner image formed on drum 13 is transferred to paper sheet P by transfer charger 37.

In this image forming operation, each of first, second, third and fourth developing devices 21, 22, 23 and 24 develops the latent image on photosensitive drum 13 corresponding to each respective color visible as a toner image, during one rotation of transfer drum 29. Thus, a plurality of color toner images are multiply-transferred onto paper sheet P during a plurality of rotations or, for this example, four rotations of transfer drum 29.

Paper supply cassette 39 is inserted into housing 41 of laser printer 11. Cassette 39 holds a supply of paper sheets P. Output tray 43 is located on the upper portion of housing 41 to receive printed paper sheets P that are output from laser printer 11. Pickup roller 45 for picking up paper sheets P from cassette 39 is provided at the top ends of cassette 39 when cassette 39 is inserted into housing 41. Paper sheet P is transported by paper supply roller 47, and then is temporarily positioned by registration roller 49. Paper sheet P is transported toward adsorption roller 51 and adsorption charger 53, which are provided to correspond to the adsorption position on transfer drum 29. After that step, paper sheet P is electrostatically adsorbed to transfer drum 29 using adsorption charger 53, and then sheet P is transported to the image transfer position.

After the toner images have been transferred to paper sheet P, paper sheet P is electrostatically discharged by pre-separation inner discharger 55, pre-separation outer discharger 57, and separation discharger 59. Then, paper sheet P is separated from transfer drum 29 by separator claw 61, and is dispensed into output tray 43 via paper transport belt 63 through fixing unit 65.

Fixing unit 65 fixes the toner image onto paper sheet P by heating and pressing paper sheet P with the toner image. Fixing unit 65 includes heat roller 67, pressure roller 69 for pressing against heat roller 67, and cleaner 71 for cleaning the surface of heat roller 67.

Any residual toner remaining on photosensitive drum 13 is discharged by pre-cleaning discharger 31, and is then scraped off by cleaning unit 33. Cleaning unit 33 includes elastic roller 73 which contacts the surface of drum 13 so as to scrape residual toner from the surface of drum 13. Discharging lamp 35 radiates the surface of photosensitive drum 13 in order to set the electrical potential of the surface of drum 13 to a uniform level.

Toner sensor 27 is located between developing unit 19 and transfer drum 29. Toner sensor 27 detects the amount of toner attached to photosensitive drum 13 (hereinafter referred to as the "toner attaching amount").

Laser printer 11 also includes controller 81 for controlling the image forming operation of laser printer 11 as shown in FIG. 2.

A detailed description will now be given of the construction relating to the control of the image forming operation of laser printer 11 shown in FIG. 1, and also referring to FIG. 2.

As described above, laser printer 11 includes main charger 15, laser unit 17, developing unit 19, toner sensor 27, and controller 81.

Main charger 15 includes charging wire 83, conductive case 85, and grid electrode 87. Charging wire 83 is coupled to corona high-voltage power supply 89 and performs corona discharging to charge the surface of photosensitive drum 13. Grid electrode 87 is coupled to grid bias high-voltage power supply 91 for applying grid bias voltage VG, and controls the charging amount on the surface of drum 13 according to the applied grid bias voltage.

The surface of photosensitive drum 13 that is uniformly charged by main charger 15 is exposed by modulated laser beam L radiated by laser unit 17 so as to form the latent image thereon. Laser unit 17 includes laser driver 93 and optical system 95 having a semiconductor laser (not shown). However, the present invention is not intended to be limited to optical systems having only a semiconductor laser, as any appropriate laser source may be substituted. Laser driver 93 receives pulse width data from gradation data buffer 97 and modulates a laser drive current according to the pulse width data supplied from gradation data buffer 97. Gradation data buffer 97 stores gradation data (image data) supplied from the host computer and corrects the gradation characteristics of the gradation data, and converts this data into pulse width data. The modulated laser drive current drives the semiconductor laser of optical system 95. Thus, the semiconductor laser generates laser beam L corresponding to pulse width data supplied from gradation data buffer 97.

Figure 3:
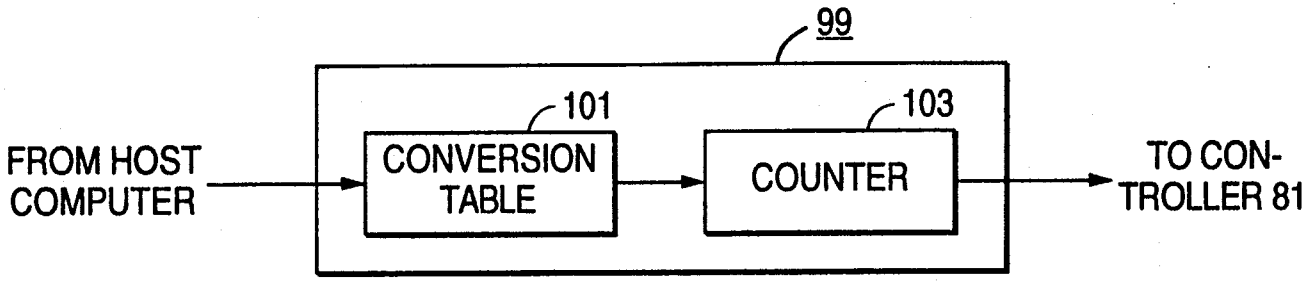
FIG. 3 is a block diagram showing an arrangement of the calculating section of the image forming apparatus shown in FIG. 2.
Figure 4:
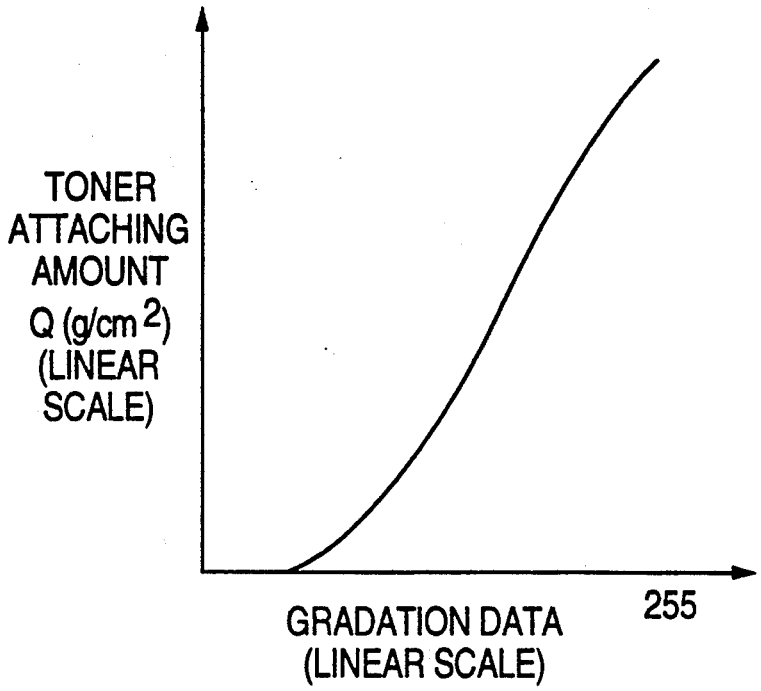
FIG. 4 is a graph showing the amount of toner attached to an image bearing member as a function of gradation data.
Figure 5:
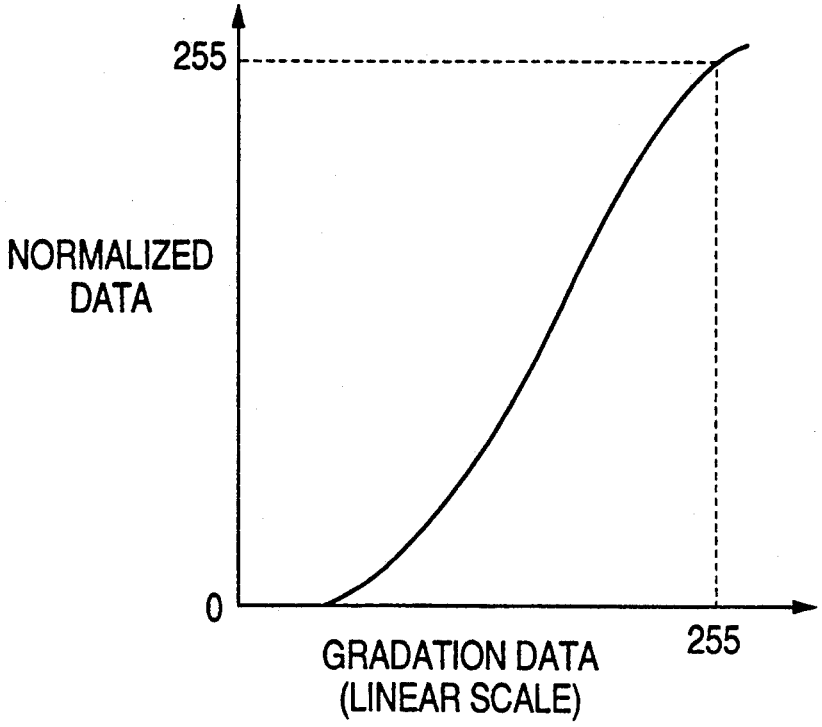
FIG. 5 is a graph showing normalized gradation data supplied from a host computer by the calculating section shown in FIG. 3.

Gradation data from the host computer is also supplied to calculating section 99 for estimating the toner attaching amount according to the supplied gradation data. As shown in FIG. 3, calculating section 99 includes conversion table 101 for normalizing the gradation data supplied from the host computer to a predetermined value corresponding to the toner attaching amount, and counter 103 for adding up the normalized data at predetermined times. Conversion table 101 stores values normalized to the toner attaching amounts in accordance with the supplied gradation data. For example, FIG. 4 shows the toner attaching amount in the case where the gradation data consist of 256 discrete levels. Therefore, as shown in FIGS. 3 and 5, conversion table 101 stores the normalized values of 0 to 255 and normalizes the gradation data supplied from the host computer to the values of 0 to 255 closely approximating the toner attaching amount in the case where the gradation data consist of 256 levels. Counter 103 adds up the normalized data, for this example, 256 times, and supplies the added data to controller 81. Thereby, calculating section 99 may estimate the toner attaching amount according to the gradation data supplied from the host computer.

The latent image formed on photosensitive drum 13 is developed by developing unit 19. As described above, developing unit 19 may include first, second, third, and fourth developing devices 21, 22, 23 and 24. However, for illustration purposes only, FIG. 2 shows only first developing device 21. First developing device 21 includes developing roller **21*a* for transporting developing agent to a developing position or station facing the surface of drum 13. Developing roller 21*a* is formed of an electrically conductive member. Developing roller 21*a* is coupled to high-voltage power supply 105 for applying developing bias voltage VD. Toner hopper 21*b* is mounted on first developing device 21. Toner hopper 21*b* stores toner and includes supply roller 21*c* for supplying the stored toner to first developing device 21. First developing device 21 may store, for example, magenta developing agent including toner and carrier. Toner density sensor 21*d* detects the weight ratio of toner to developing agent (hereinafter referred to as the "toner density"). Toner density sensor 21*d* is coupled to controller 81 through analog/digital (A?D) converter 107. Motor 109 rotates toner supply roller 21*c* so as to supply toner in accordance with the toner density detected by toner density sensor 21*d*. The structures and operations of second, third, and fourth developing devices 22, 23 and 24 are substantially similar to that of first developing device 21. Thus, the color toner image is formed on the surface of photosensitive drum 13 by developing unit 19 having first, second, third and fourth developing devices 21, 22, 23 and 24. The toner image thus formed on the surface of drum 13 is transferred to paper sheet P conveyed by transfer drum 29 (see FIG. 1**).

Figure 6:
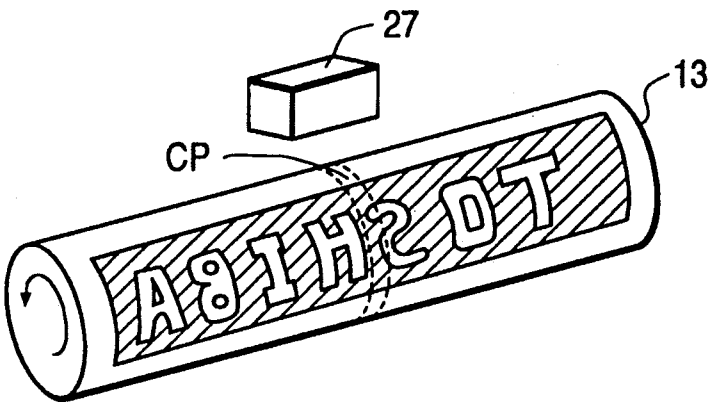
FIG. 6 shows the arrangement and relationship between the toner sensor and the image bearing member shown in FIG. 2.

Toner sensor 27 detects the toner attaching amount in synchronization with the point in time at which the toner image formed on the surface of drum 13 reaches the position of toner sensor 27. As shown in FIG. 6, toner sensor 27 detects the toner attaching amount on center portion CP of drum 13, since the probability of the gradation pattern being formed is high in center portion CP. Thus, for example, toner sensor 27 would detect the toner attaching amount of gradation data of 256 separate dots in the case where the gradation data consist of 256 levels.

Figure 7:
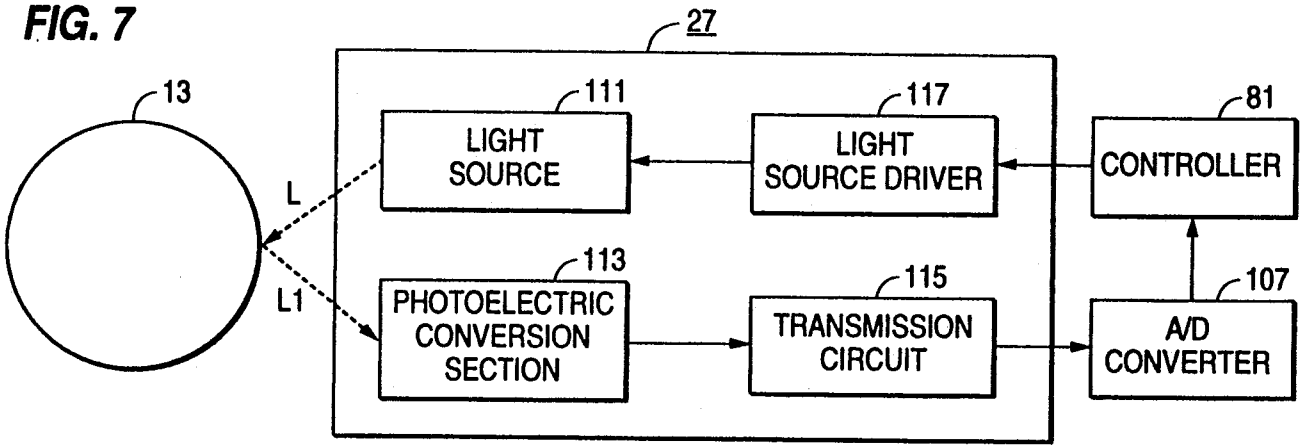
FIG. 7 is a block diagram showing an arrangement of the toner sensor shown in FIG. 6.

As shown in FIG. 7, toner sensor 27 includes light source 111, photoelectric conversion section 113, and transmission circuit 115. Light source 111 radiates light beam L onto the surface of photosensitive drum 13. Photoelectric conversion section 113 converts light beam L1 reflected from the surface of drum 13 into a voltage corresponding to the amount or intensity of the reflected light beam. The voltage converted by photoelectric conversion section 113 is supplied to A/D converter 107 through transmission circuit 115 and is converted into a digital signal so as to detect the toner attaching amount on center portion CP of drum 13 (see FIG. 6). Light source driver 117 supplies a drive current to light source 111 so as to generate the light beam. Controller 81 controls light source driver 117 so as to adjust the amount of the drive current supplied from light source driver 117 to light source 111.

Figure 8:
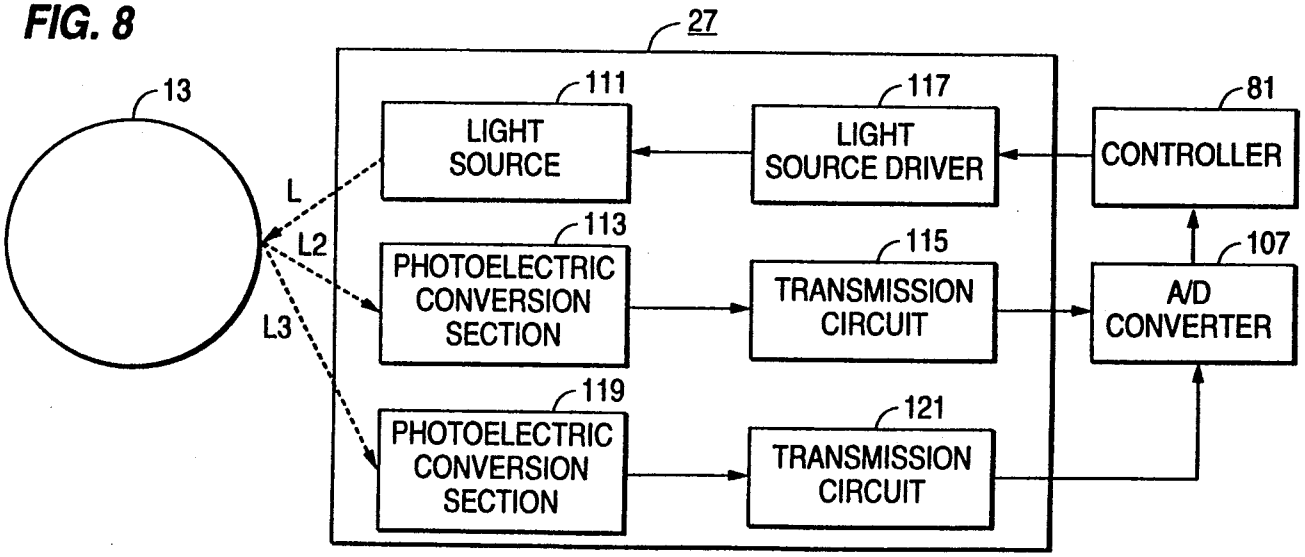
FIG. 8 is a block diagram showing another arrangement of the toner sensor shown in FIG. 6.

Referring to FIG. 8, in another embodiment of the present invention, toner sensor 27 further includes photoelectric conversion section 119 and transmission circuit 121. In this embodiment, photoelectric conversion section 113 is located at a position where it may receive light beam L2 having a principal ray reflected directly from the surface of drum 13. Photoelectric conversion section 119 is located at a position where it may receive light beam L3 having no principal ray reflected directly from the surface of drum 13 (i.e., indirect light). Thus, photoelectric conversion section 113 detects directly reflected light beam L2 from the surface of drum 13, and photoelectric conversion section 119 detects divergent reflected light beam L3 from the surface of drum 13. Thereby, toner sensor 81 more accurately measures the toner attaching amount on center portion CP of the surface of photosensitive drum 13.

Figure 9:
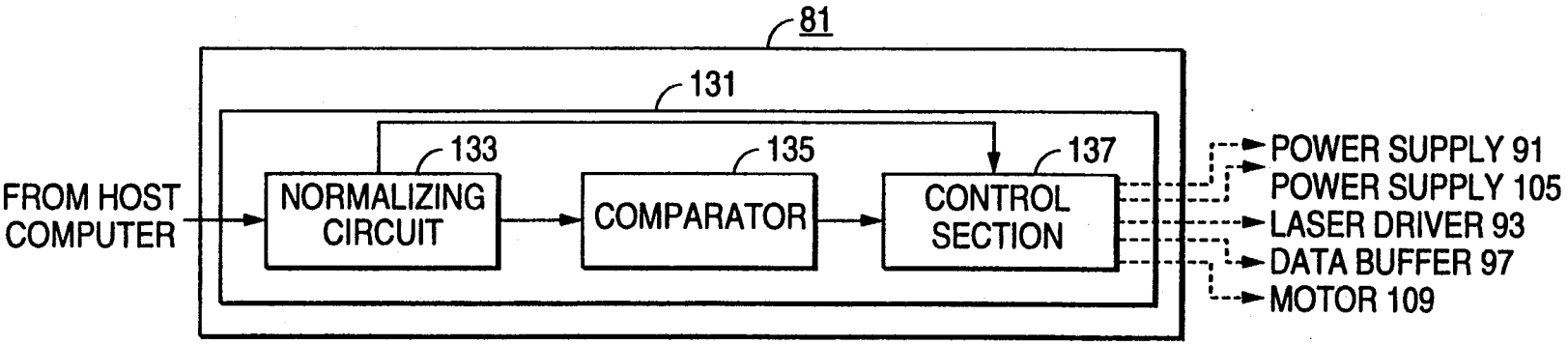
FIG. 9 is a block diagram showing an arrangement of the controller shown in FIG. 2.

Referring to FIG. 9, controller 81 includes image forming controller 131 for controlling the image forming conditions so as to correct image density changes due to changes in the operating environment or a deterioration over time independently of the conventional maintenance of materials and process tolerances. Image forming controller 131 includes normalizing circuit 133 for averaging the toner attaching amount estimated by calculating section 99. For example, normalizing circuit 133 divides the estimated toner attaching amount by 256, when counter 103 adds up the normalized data 256 times. Image forming controller 131 also includes comparator 135 and control section 137. Comparator 135 receives the toner attaching amount detected by toner sensor 27, and the toner attaching amount estimated by calculating section 99 through normalizing circuit 133, and compares the detected toner attaching amount with the estimated toner attaching amount. Control section 137 controls the image forming conditions, for example, for at least one of grid bias voltage VG applied to main charger 15, developing bias voltage VD applied to developing unit 19, the exposure amount PL of laser beam L generated by laser unit 17, toner density TD of the developing agent stored in developing unit 19, or the pulse width PD of laser beam L generated by laser unit 17, in accordance with the comparison results from comparator 135 so as to correct for the image density variations.

Figure 10:
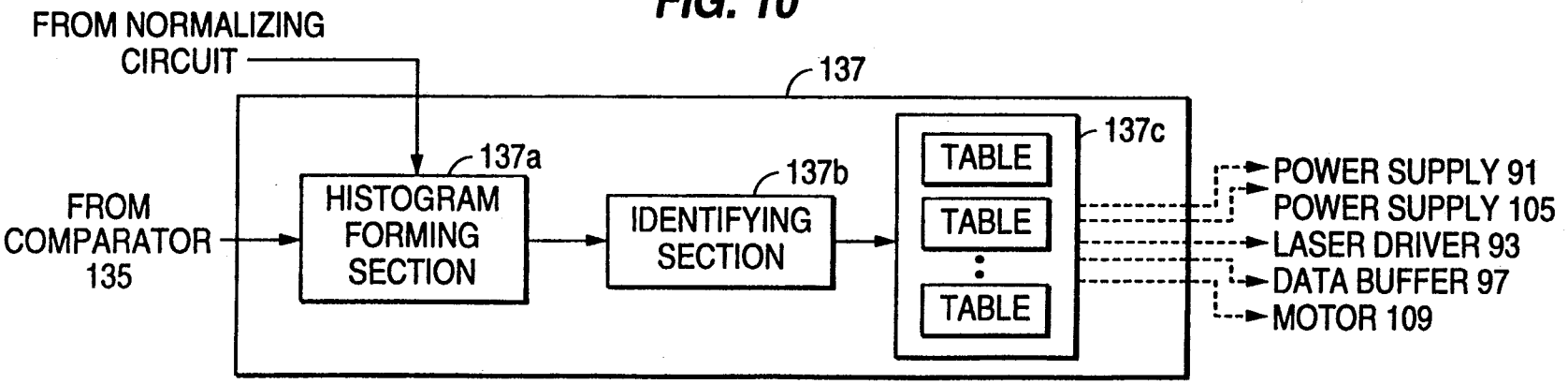
FIG. 10 is a block diagram showing an arrangement of the control section of the image forming controller shown in FIG. 9.
Figure 11:
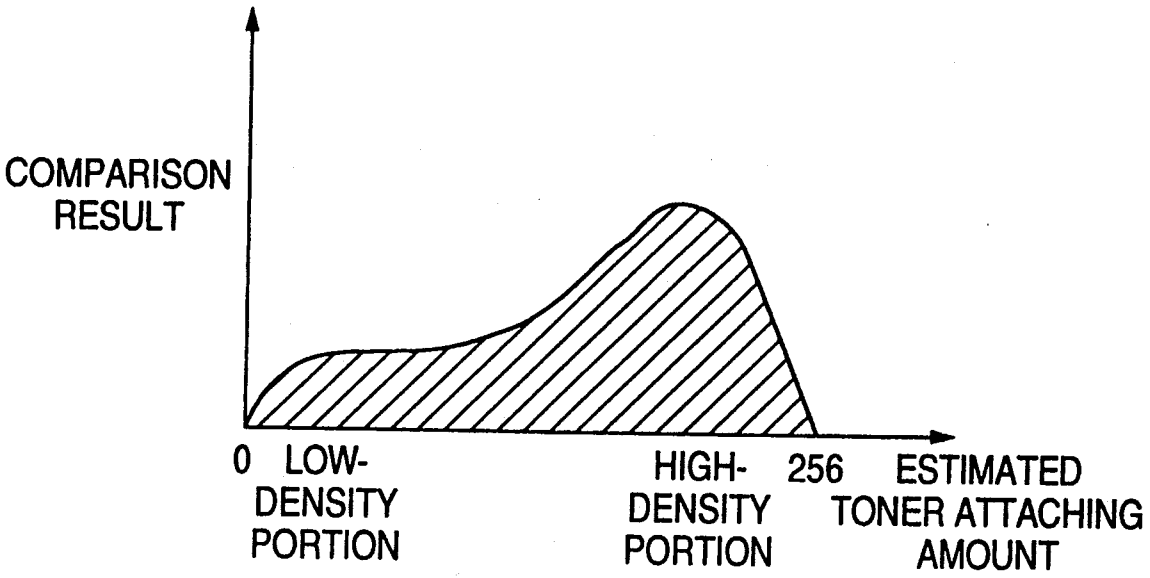
FIG. 11 illustrates an example of a histogram formed by the controller shown in FIG. 2.

In the present embodiment, toner sensor 27 detects the toner attaching amount on center portion CP of drum 13, and calculating section 99 estimates the toner attaching amount in accordance with data supplied from the host computer at a plurality of times or, as an example, 100 times, and comparator 135 compares each detected toner attaching amount with each estimated toner attaching amount. Referring also to FIG. 10, control section 137 includes histogram forming section 137*a* for forming a histogram in accordance with each comparison result of comparator 135 so as to detect the frequency distribution of the image density changes with respect to a high-density portion and a low-density portion of the gradation data. FIG. 11 shows an example of a histogram formed by histogram forming section 137*a*. In this case, the transverse axis of the histogram is the toner attaching amount estimated by calculating section 99, and the longitudinal axis of the histogram is the comparison result of comparator 135.

Control section 137 includes identifying section 137*b* for detecting the frequency distribution of the image density changes with respect to the high-density portion and the low-density portion of the gradation data, and identifying the trend of the image density changes. Identifying section 137*b* determines to what extent the grid bias voltage VG, developing bias voltage VD, exposure amount PL, toner density TD, and pulse width PD of laser beam L have changed in accordance with the identified trend of the image density changes with respect to the high-density portion and the low-density portion. Identifying section 137*b* then changes the directly above-described parameters to compensate for the original changes. Control section 137 also includes storage portion 137*c* having a plurality of tables for storing a plurality of correction values so as to change the image forming conditions in response to the parameter changes from identifying section 137*b*. Thereby, in order to compensate for an image density chan may change at least one of the parameters grid bias voltage VG, developing bias voltage VD, exposure amount PL, toner density TD, or pulse width PD of laser beam L, by reading the correction value of the changed parameters determined by identifying section 137*b* from the tables in storage portion 137*c* corresponding to the detected image density change.

Referring now to FIGS. 12 through 21, the control operations for image forming conditions will now be described.

Figure 12:
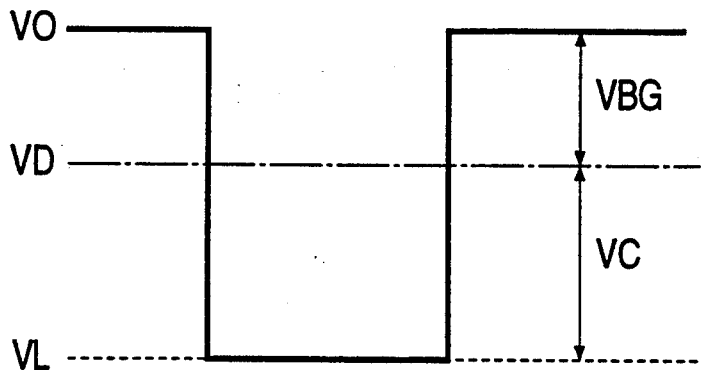
FIG. 12 shows the relationship between constant electrical potential and background electrical potential.
Figure 13:
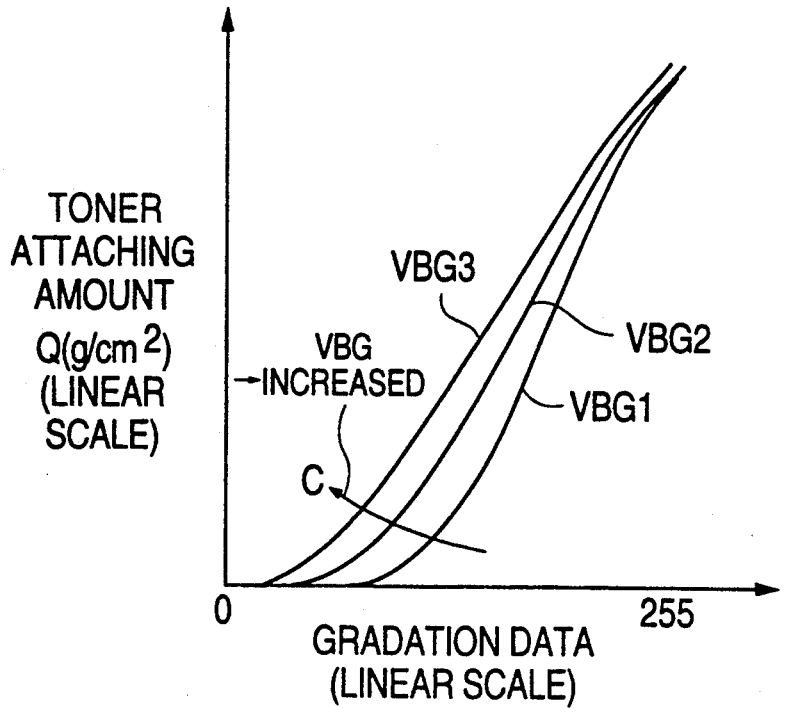
FIG. 13 is a graph showing the amount of toner attached to the image bearing member shown in FIG. 1 as a function of the gradation obtained when the background potential is changed.

FIG. 12 shows the relationship between contrast electrical potential VC and background electrical potential VBG, with respect to a surface potential VO on photosensitive drum 13 uniformly charged by main charger 15 (hereinafter referred to as a "non-exposed portion potential"), surface potential VL of drum 13 exposed to laser light beam L from laser unit 17 (hereinafter referred to as an "exposed portion potential"), and developing bias potential VD. FIG. 13 shows toner attaching amount Q as a function of the gradation data when the background potentials (VBG1, VBG2, and VBG3, where VBGL<VBG2<VBG3) are increased. A low-density region is shown as a shift in the direction of arrow C in FIG. 13.

As shown in FIG. 14(*a*), the toner attaching amount of the low-density portions of the image forming portion (the cross-hatched areas in FIG. 14(*a*)) may be changed when background potential VBG changes. To the contrary, as shown in FIG. 14(*b*), the toner attaching amount of the high-density portions of the image forming portion (the cross-hatched areas in FIG. 14(*b*)) scarcely change when background potential VBG changes.

Referring now to FIG. 15, constant potential VC depends on the high-density portions of the image forming portion. Thus, image density ID of the high-density portions may be changed when constant potential VC changes. However, the image density of the low-density portions is hardly changed when constant potential VC changes. Toner attaching amount Q can be changed by varying contrast potential VC or background potential VBG. Therefore, control section 137 controls contrast potential VC and background potential VBG so as to stabilize the image density of the image formed on the surface of photosensitive drum 13.

FIG. 16 shows the relationships between non-exposed portion potential VO, exposed portion potential VL, and developing bias potential VD, with respect to grid bias voltage VG applied to grid electrode 87 of main charger 15.

When grid bias voltage VG is increased, non-exposed portion potential VO and exposed portion potential VL are respectively decreased. The relationship between non-exposed portion potential VO and exposed portion potential VL, with respect to grid bias voltage VG can be linearly approximated as follows:

$$f_{VO}(VG)=K1*VG+K2 \quad (1)$$

$$f_{VL}(VG)=K3*VG+K4 \quad (2)$$

where K1 to K4 are constants.

The developing density changes in accordance with the relationship between developing bias voltage VD, exposed portion potential VL, and non-exposed portion potential VO.

Also, contrast potential VC and background potential VBG are defined as follows:

$$VC=f_{VD}(VG)-f_{VL}(VG) \quad (3)$$

$$VBG=f_{VO}(VG)-f_{VD}(VG) \quad (4)$$

The following equations are obtained from equations (1) to (4):

$$f_{VG}(VC, VBG)=(VC+VBG-K2-K4)/(K1+K3) \quad (5)$$

$$f_{VD}(VBG, VG)=(K1*VG+K2-VBG) \quad (6)$$

From equations (5) and (6), grid bias voltage VG and developing bias voltage VD may be determined from contrast potential VC and background potential VBG when the relationship (K1, K2) of exposed portion potential VL and non-exposed portion potential VO, with respect to grid bias voltage VG is found.

The surface of photosensitive drum 13 is measured in advance to obtain the relationship (K1, K2) of exposed portion potential VL and non-exposed portion potential VO, with respect to grid bias voltage VG. From equations (5) and (6), grid bias voltage VG and developing bias voltage VD are uniquely determined when contrast potential VC and background potential VBG are set.

The operations for changing grid bias voltage VG and developing bias voltage VC will now be described.

First of all, a predetermined density pattern is formed on photosensitive drum 13. Toner sensor 27 detects the toner attaching amounts and calculating section 99 estimates the toner attaching amounts in accordance with the predetermined density pattern at a plurality of times. Comparator 135 of image forming controller 131 compares the detected toner attaching amounts with the estimated toner attaching amounts. Histogram forming section 137*a* of control section 137 forms the histogram in accordance with the estimated toner attaching amounts and the comparison results of comparator 135. Thereby, identifying section 137*b* detects the frequency distribution of the image density changes with respect to the high-density portion and the low-density portion of the gradation data, and identifies the trend of the image density changes. Identifying section 137*b* then estimates the correction values for contrast potential VC and background potential VBG needed to correct for the image density changes. In this case, storage section 137*c* of control section 137 includes a first table for storing a plurality of correction values for contrast potential VC, and a second table for storing a plurality of correction values for background potential VBG. Thereby, identifying section 137*b* may select the correction values of contrast potential VC and background potential VBG from the first and second tables, in accordance with the identified trend of the image density changes. Control section 137 estimates grid bias voltage VG and developing bias voltage VD from equations (5) and (6) based on the correction values for contrast potential VC and background potential VBG, and causes grid bias voltage VG and developing bias voltage VD to change accordingly. This operation is repeated until the image density changes fall within an allowable tolerance range. Thereby, control section 137 may correct the image density changes due to changes in the operating environment or a deterioration over time independently of the conventional maintenance of materials and process tolerances.

FIG. 17 shows how toner attaching amount Q varies as a function of exposure amount PL of laser beam L1. In this embodiment, the low density portion of the gradation data mainly changes when the exposure amounts (PL1, PL2 and PL3, where PL1<PL2<PL3) of laser beam L1 change as shown in FIG. 18. Toner attaching amount Q may be corrected by changing the exposure amount PL of laser beam L1 with respect to the low-density portion. Also, exposed portion potential VL is changed when the exposure amount PL of laser beam L1 is changed. Thus, for example, control section 137 operates to change developing bias voltage VD and exposure amount PL of laser beam L1 so as to correct for the image density changes.

FIG. 19 shows the relationship between toner density TD and toner attaching amount Q. Toner attaching amount Q monotonically increases as a function of toner density TD. A lower limit value TD1 of toner density TD is obtained empirically based on the amount of the carrier attached to the surface of photosensitive drum 13. An upper limit value TD2 of toner density TD is obtained empirically based on the amount of non-charged toner. Toner density TD may change within the range defined between lower limit value TD1 and upper limit value TD2. For this example, the lower limit value TD1 is about 3 wt(weight) %, and the upper limit value TD2 is about 8 wt %.

FIG. 20 shows a change in toner attaching amount Q as a function of gradation data when toner densities (TD3, TD4 and TD5, where TD1<TD3<TD4<TD5<TD2) are increased. The high-density region of gradation data is shown as a shift in the direction of arrow f in FIG. 20. In this embodiment, the high-density portion of the gradation data mainly changes when the toner density TD changes. Thus, for example, control section 137 may change the developing bias voltage VD and toner density TD of the developing agent stored in developing unit 19 so as to correct for the image density changes. In this case, control section 137 changes the developing bias voltage VD to correct for the image density changes with respect to the low-density portion of the gradation data. Control section 137 also changes the toner density TD to correct for the image density changes with respect to the high-density portion of the gradation data.

FIG. 21 shows the gradation data (image data), pulse width PD of laser beam L1, toner attaching amount Q, and image density ID of the image formed on paper sheet P. In this embodiment, pulse width PD, toner attaching amount Q, and image density ID, with respect to the gradation data have a correspondence therebetween. When toner attaching amount Q varies (alternating long and short dashed curve g) due to a deterioration of the image over time or a change in the operating environment, the relationship between the gradation data and toner attaching amount Q may be kept constant by changing between the gradation data and pulse width PD (alternating long and two short dashed curve h). As an example, in the case where there exists a larger number of levels of pulse width PD (i.e., 4096 levels) than levels of gradation data (i.e., 256 levels), various pulse widths PD may be optionally selected with each PD corresponding to the gradation data. So, if toner attaching amount Q were to vary from point a to point b, in this example, pulse width PD could be changed from 200 to 230 in order to compensate. Thus, control section 137 may change grid bias voltage VG, developing bias voltage VD, and pulse width PD so as to correct for image density changes.

Additionally, in this embodiment, control section 137 may change toner density TD and pulse width PD so as to correct for image density changes. In such a case, control section 137 changes pulse width PD to correct for the image density changes with respect to the low-density portion of the gradation data, and toner density TD to correct for the image density changes with respect to the high-density portion of the gradation data.

As described above, with respect to the present embodiment, color laser printer 11 includes toner sensor 27 for detecting the toner attaching amount on center portion CP of photosensitive drum 13, and calculating section 99 for estimating the toner attaching amount in accordance with the gradation data supplied from the host computer. Color laser printer 11 also includes controller 81 having comparator 135 for comparing the detected toner attaching amount with the estimated toner attaching amount, and control section 137 for changing the image forming conditions such as, for example, grid bias voltage VG, developing bias voltage VD, exposure amount PL of laser beam L1, toner density TD, and pulse width PD of laser beam L1 so as to correct for the image density changes of the image formed on photosensitive drum 13. Thus, in accordance with the present invention, color laser printer 11 can correct for the image density changes due to changes in the operating environment or a deterioration over time independently of the conventional maintenance of materials and process tolerances, and during a shorter cycle than the maintenance cycle. Also, in accordance with this invention, color laser printer 11 may form an image having a stable high image density on the surface of photosensitive drum 13.

In the embodiment described directly above, calculating section 99 includes conversion table 101 and counter 103 (see FIG. 3). Alteratively, in another embodiment, referring now to FIG. 22, calculating section 99 may include counter 139 which is coupled to controller 81. Counter 139 adds up the discrete values of gradation data, such as in the earlier example, 0 to 255, so as to estimate the toner attaching amounts corresponding to the gradation data values. In this instance, controller 81 supplies an enable signal to counter 139 so as to add up only the gradation data values corresponding to the toner attaching amounts detected by toner sensor 27. The enable signal is generated by controller 81 in correspondence with a clock signal supplied to the host computer. Thereby, calculating section 99 estimates the toner attaching amounts Q in accordance with the image data to be formed on photosensitive drum 13. The toner attaching amounts estimated by counter 139 of calculating section 99 are supplied to normalizing circuit 133 for averaging the estimated toner attaching amounts.

In the embodiments described above, one type of image forming apparatus for forming a color image on an image bearing member may be a color laser printer. Alternatively, however, the present invention is applicable to other types of image forming apparatuses, such as color digital copying machines and so forth.

This invention has been described in detail in connection with the preferred embodiments, but that is for illustrative purposes only, and the invention is not limited thereto. It will be easily understood by those skilled in the art that variations and modifications can easily be made within the scope of this invention as defined by the appended claims.

We claim:

1. An apparatus for use in forming an image corresponding to digital image data supplied from a host computer on an image bearing member, said apparatus comprising:

means for receiving digital image data to be formed and supplied from said host computer;

means for estimating the amount of toner to be attached to said image bearing member in accordance with the digital image data received by said receiving means;

means for forming an image on said image bearing member, said image corresponding to digital image data to be formed and supplied from said host computer with a developing agent including toner under a predetermined image forming condition;

means for detecting the amount of toner attached to said image bearing member by said forming means; and control means for setting said image forming condition in accordance with the amount of toner detected by said detecting means and the amount of toner estimated by said estimating means and performing the image forming operation of said forming means under said set image forming condition so as to stabilize image density changes of the image formed on said image bearing member.

2. The apparatus according to claim 1, wherein said estimating means includes means for normalizing the image data to be formed to a predetermined value corresponding to the amount of toner attached to said image bearing member.

3. The apparatus according to claim 2, wherein said estimating means includes means for adding up the values normalized by said normalizing means.

4. The apparatus according to claim 1, wherein said forming means includes means for charging said image bearing member, means for exposing a light beam on said image bearing member so as to form a latent image on said image bearing member, and developing means for developing the latent image formed on said image bearing member.

5. The apparatus according to claim 4, further comprising first applying means for applying a grid bias voltage to said charging means and second applying means for applying a developing bias voltage to said developing means.

6. The apparatus according to claim 5, wherein said control means comprises:

means for comparing the amount of toner detected by said detecting means and the amount of toner estimated by said estimating means; and means for changing at least one of the grid bias voltage applied by said first applying means, the developing bias voltage applied by said second applying means, the exposure amount of the light beam exposed by said exposing means, the pulse width of the fight beam exposed by said exposing means, and the ratio of the toner included in said developing agent in accordance with the comparison results from said comparing means.

7. The apparatus according to claim 1, wherein said detecting means includes means for measuring the amount of toner attached to a center portion of said image bearing member.

8. An apparatus for use in forming an image corresponding to digital image data and supplied from a host computer on an image bearing member, said apparatus comprising:

means for receiving digital image data to be formed and supplied from said host computer;

means for estimating the amount of toner to be attached to said image bearing member in accordance with the digital image data received by said receiving means;

means for charging said image bearing member;

means for exposing a light beam on said image bearing member so as to form a latent image on said charged image bearing member corresponding to digital image data to be formed and supplied from said host computer;

means for developing the latent image formed on said image bearing member with a developing agent including toner;

means for detecting the amount of toner attached to said image bearing member by said developing means; and means for controlling said charging means, said exposing means and said developing means with the amount of toner detected by said detecting means and the amount of toner by said estimating means so as to stabilize the image density changes of the image formed on said image bearing member.

9. The apparatus according to claim 8, wherein said estimating means includes means for normalizing the image data to be formed to a predetermined value corresponding to the amount of toner attached to said image bearing member.

10. The apparatus according to claim 9, wherein said estimating means includes means for adding up the values normalized by said normalizing means.

11. The apparatus according to claim 8, further comprising first applying means for applying a grid bias voltage to said charging means and second applying means for applying a developing bias voltage to said developing means.

12. The apparatus according to claim 11, wherein said control means comprises:

means for comparing the amount of toner detected by said detecting means and the amount of toner estimated by said estimating means; and means for changing at least one of the grid bias voltage applied by said first applying means, the developing bias voltage applied by said second applying means, the exposure amount of the light beam exposed by said exposing means, the pulse width of the light beam exposed by said exposing means, and the ratio of toner included in said developing agent in accordance with the comparison results from said comparing means.

13. The apparatus according to claim 8, wherein said detecting means includes means for measuring the amount of toner attached to a center portion of said image bearing member.

14. An apparatus for use in forming an image on an image bearing member the image corresponding to digital image data supplied from a host computer, said apparatus comprising:

means for receiving digital image data to be formed and supplied from said host computer;

means for estimating the amount of toner to be attached to said image bearing member in accordance with the digital image data received by said receiving means;

means for charging said image bearing member;

means for exposing a light beam on said image bearing member so as to form a latent image on said charged image bearing member corresponding to digital image data to be formed and supplied from said host computer;

means for developing the latent image formed on said image bearing member with a developing agent including toner;

means for detecting the amount of toner attached to said image bearing member by said developing means;

means for applying a grid bias voltage to said charging means;

means for applying a developing bias voltage to said developing means; and means for controlling said charging means, said exposing means and said developing means by changing at least one of the grid bias voltage applied by said grid bias voltage applying means, the developing bias voltage applied by said developing bias voltage applying means, the exposure amount of the light beam exposed by said exposing means, the pulse width of the light beam exposed by said exposing means, and the ratio of toner included in said developing agent in accordance with the result of comparing the amount of toner detected by said detecting means and the amount of toner estimated by said estimating means.

15. An apparatus for use in forming an image corresponding to digital image data supplied from a host computer on an image bearing member, said apparatus comprising:

means for receiving digital image data to be formed and supplied from said host computer;

means for estimating the amount of toner to be attached to said image bearing member in accordance with the digital image data received by said receiving means;

means for forming an image on the image bearing member, said image corresponding to digital image data to be formed and supplied from said host computer with a developing agent including toner under a predetermined image forming condition;

means for detecting the amount of toner attached to said image bearing member by said forming means;

comparing means for comparing the amount of toner detected by said detecting means and the amount of toner estimated by said estimating means;

identifying means for detecting the frequency distribution of the image density changes with respect to a high-density portion and a low-density portion of the digital image data in accordance with each comparison result of said comparing means and identifying the trend of the image density changes; and control means for setting said image forming condition in accordance with the identified trend of the image density changes with respect to the high-density portion and the low-density portion and performing the image forming operation of said forming means under said set image forming condition so as to stabilize image density changes of the image formed on said image bearing member.

16. A method for use in forming an image on an image bearing member, the image corresponding to digital image data supplied from a host computer, said method comprising the steps of:

receiving digital image data to be formed supplied from said host computer;

estimating the amount of toner to be attached to said image bearing member in accordance with the received digital image data;

forming an image on said image bearing member, said image corresponding to digital image data to be formed supplied from said host computer with a developing agent including toner under a predetermined image forming condition;

detecting the amount of toner attached to said image bearing member;

setting said image forming condition in accordance with the detected amount of toner and the estimated of toner; and performing the image forming operation of said forming means under said set image forming condition so as to stabilize image density changes of the image formed on said image bearing member.

* * * * *